US010827864B2

(12) United States Patent
Ronk

(10) Patent No.: US 10,827,864 B2
(45) Date of Patent: Nov. 10, 2020

(54) RETAINING DEVICE FOR HANGING GARMENT HANGERS

(71) Applicant: Clara K. Ronk, Brooklyn, NY (US)

(72) Inventor: Clara K. Ronk, Brooklyn, NY (US)

( * ) Notice: Subject to any disclaimer, the term of this patent is extended or adjusted under 35 U.S.C. 154(b) by 67 days.

(21) Appl. No.: 16/261,891

(22) Filed: Jan. 30, 2019

(65) Prior Publication Data

US 2020/0237129 A1 Jul. 30, 2020

(51) Int. Cl.
*A47G 25/14* (2006.01)

(52) U.S. Cl.
CPC ..... *A47G 25/1478* (2013.01)

(58) Field of Classification Search
CPC ..... A47G 25/145; A47G 25/1457; A47G 25/1464; A47G 25/1471; A47G 25/1478
USPC ..... 211/7, 105.1, 123, 124; 223/85, 90, 91, 223/93, 96, 98
See application file for complete search history.

(56) References Cited

U.S. PATENT DOCUMENTS 2,868,390 A * 1/1959 McCrone ..... E05B 69/006 211/124
3,298,503 A * 1/1967 Field ..... B65D 85/185 206/279
3,306,465 A * 2/1967 Brennan ..... A47B 61/003 211/124
3,419,154 A * 12/1968 Shapiro ..... A47F 7/24 211/7
3,610,423 A * 10/1971 Parillo ..... A47F 7/24 211/7
3,659,721 A * 5/1972 Parillo ..... A47G 25/0692 211/7
3,735,875 A * 5/1973 Parillo ..... E05B 69/006 211/7
4,139,102 A * 2/1979 Winton ..... E05B 69/006 211/124
4,340,145 A * 7/1982 Cameron ..... A47G 25/145 211/124
4,753,355 A * 6/1988 Hall ..... A47G 25/145 211/105.1
4,811,853 A * 3/1989 Mead ..... B65D 85/185 206/279
5,092,473 A * 3/1992 Zelniker ..... A47F 7/24 211/124
5,509,542 A * 4/1996 Simmerman ..... A47G 25/0692 211/124
5,823,358 A * 10/1998 Leyden ..... A47F 5/0861 211/8
6,948,628 B1 * 9/2005 Sahlem ..... A47G 25/0692 211/105.1

(Continued)

*Primary Examiner* — Joshua E Rodden

(57) ABSTRACT

An improved garment hanger retaining device discloses a convenient means to secure a plurality of hangers that hang on a suspended hangrod such as, a rolling rack, road case, trunk, crate, existing hangrod, or wardrobe truck, particularly while moving or transporting hanging objects such as, garments, wardrobe, costumes, or props. Various embodiments comprise an elongated, inverted generally U-shaped main body channel adapted to clamp onto the span of a suspended hangrod thereby capping a hanger hook portion of a garment hanger. With minimal action a user can engage by clamping on or disengage by lifting off. Improvement over prior art benefit a readily available, transferrable and reusable device, with no moving parts, components or assembly.

3 Claims, 2 Drawing Sheets

(56) References Cited

U.S. PATENT DOCUMENTS

| | | | | |
|---|---|---|---|---|
| 8,016,138 | B2 * | 9/2011 | Jacobson | A47F 5/0838 211/113 |
| 8,127,947 | B2 * | 3/2012 | Chacon | B60R 9/00 211/123 |
| 8,387,808 | B2 * | 3/2013 | Radowski | A47G 25/1464 211/123 |
| 2002/0148797 | A1 * | 10/2002 | Feder | B65D 85/185 211/124 |

* cited by examiner

RETAINING DEVICE FOR HANGING GARMENT HANGERS

CROSS-REFERENCE TO OTHER APPLICATIONS

Not Applicable

STATEMENT OF FEDERALLY SPONSORED RESEARCH OR DEVELOPMENT

Not applicable

REFERENCE TO A "SEQUENCE LISTING

Not applicable

REFERENCES CITED. U.S. PATENT DOCUMENTS

| | | |
|---|---|---|
| U.S. Pat. No. 4,037,728 | Jul. 26, 1977 | Cameron |
| U.S. Pat. No. 4,760,929 | Aug. 28, 1988 | Fedorchak |
| U.S. Pat. No. 4,139,102 | Feb. 13, 1979 | Winton |
| U.S. Pat. No. 5,509,542 | Apr. 23, 1996 | Simmerman et al. |
| U.S. Pat. No. 6,948,628 | Sep. 27, 2005 | Sahlem |
| U.S. Pat. No. 8,016,138 | Sep. 13, 2011 | Jacobson |
| U.S. Pat. No. 8,387,808 B2 | Mar. 5, 2013 | Radowski |

BACKGROUND OF THE INVENTION

1. Field of the Invention

The present invention discloses an improved device for retaining a plurality of garment hangers that hang on a suspended hangrod particularly while moving or transporting.

2. Discussion of the State of the Art

Routinely, garment hangers that hang on a suspended hangrod can become displaced while moving or transporting. Particularly, the present device is directed to retaining hanging objects such as, garments, wardrobe, costumes, uniforms, or props in the field of for example, fashion, entertainment, or production, pertaining to such as, fashion shows, film, television, theater or event industries.

More particularly, the present invention discloses an elongated and inverted generally U-shaped main body channel adapted to receive thereby clamp atop a span of a suspended hangrod further capping over a hanger hook portion of one or a collection of hanging garment hangers. While the invention has particular utility on a suspended hangrod, it will be understood the present device is by no means limited thereto affixing onto a suspended hangrod but includes for instance, a rolling rack, road case, trunk, crate, existing hangrod, or wardrobe truck known to users with experience in the field of art.

Furthermore, it is known to users in the field of the art, there lacks an uncomplicated readily available device that can ensure said hanging objects are not displaced when moving or transporting. Said users may move and transport a large quantity of said objects to and from varied work environments or locations which often have unforeseen situations with which to contend. For example, while backstage, particularly while on a tour, a user may move hanging objects a short distance from stage left to stage right or a greater distance such as, from a storage facility to film set, or from a wardrobe truck to a remote location. Therefore, because said users so frequently move and change work environments or locations, prior art is not readily found and further, is limiting by requiring advanced and permanent installation.

Adversely, when lacking a readily available securing device, it is known to the inventor that said users have implemented methods like applying tape, foam, rope, zip ties, bungie cord, or more. It is the inventor's opinion such applications are inadequate, messy, wasteful and time consuming tasks. Therefore, what is clearly needed is a conveniently accessible and transferable device that requires minimal or no assembly, and with a simple user action, is reusable.

The present device shows improvement by securing a plurality of hangers thereby not limiting a user to particular number of hanging objects. Prior art of U.S. Pat. No. 4,760,929 on Aug. 28, 1988 to Fedorchak, shows a limitation by a specific number of per hanger spacing notches therefore can effect a quantity of objects to hang.

Furthermore, prior art U.S. Pat. No. 8,016,138 on Sep. 13, 2011 to Jacobson, provides a single hanger interlocking device that can thereby hinder a user intending to secure a large or unknown quantity of hanging objects. The main body channel of the present device shows improvement directed toward securing one or a collection of hanging objects upon a span of a suspended hangrod.

Considering too, the present invention benefits a "clean" device requiring no assembly or moving parts such as, hinges, springs or straps that may soil or damage hanging objects. Prior art of U.S. Pat. No. 8,387,808 B2 on Mar. 5, 2013, to Radowski and U.S. Pat. No. 5,509,542 on Apr. 23, 1996, to Simmerman et al. has such parts, requires permanent installation and further, is therefore not easily transferable.

Additionally, various embodiments of the present invention improve over prior art by a lightweight plastic main body that requires no assembly or disassembly. Improvement is directed to transferability with a simple user action; to disengage a user can place fingertips and thumb onto an open space, a distance between a first end or spaced apart second end and an inset clamping member to lift off and remove.

Further, the present invention having various benefits over prior art in U.S. Pat. No. 6,948,628 on Sep. 27, 2005 to Sahlem, will be noted. For example, the present invention caps atop a hanger hook portion of a hanger. While having certain embodiments of dimension and form benefit an open underside space to thereby accommodate various hanger hook size or shapes. Furthermore, benefit of an open underside space at opposing ends can allow clearance of a connector that may retain a suspended hangrod such as, bracket, fastener, or an end finial. More specifically, limitations to U.S. Pat. No. 6,948,628 on Sep. 27, 2005 to Sahlem show a device that sits directly onto a particular hanger hook portion which may limit use with varied hanger hook sizes routinely found in the field of the art. Further, prior art shows moving parts both for expandability and with a hook and loop strapping closure (known as Velcro). It's the inventor's opinion and too, known to users in the field of the art, this strapping can potentially damage delicate, valuable hanging objects. Furthermore, although prior art is expandable, a feature of "having respective flanges that extend inwardly at each end" can be limiting. This feature may restrict prior art application thereto a span of a hangrod such as a collapsible rolling garment rack, commonly manufactured and routinely found in the field of the art. For example, said garment rack consists of a hangrod with particular circular disc finials attached at opposing ends whereby application of prior art can be restricted by "having respective flanges that extend inwardly at each end". Improvement of the present invention comprises an open underside main body channel with clamping members fastened at an inset distance of a first end and a spaced apart second end to thereby allow a hollow open space at opposing ends.

Pre-installation is revealed in prior art U.S. Pat. No. 4,037,728 on Jul. 26, 1977, to Cameron and U.S. Pat. No. 4,139,102 on Feb. 13, 1979 to Winton, and is limited by requiring assembly, permanent placement, and a retention bar with moving parts. Further aspects of the present device can benefit a quick user action whereby to engage, push down to clamp onto a suspended hangrod or inversely, lift up and off to disengage. It is understood the present invention benefits prior art by providing an independent, transferable, and improved application. Certain embodiments enable a user with skill in the art to appreciate and make use of improved solutions using a convenient, interchangeable application and an uncomplicated action. Simplicity and ease of use can be apparent to those of ordinary skill in the art, discernible to a skilledartisan in which the embodiments describe.

There may be many alterations made in discretion without departing from the spirit and scope of the present invention. As disclosed in this specification and claims, the terms, "for example," "for instance," or "such as," and their other verb forms, when used in conjunction with a listing of one or more components or other items, are each to be construed as open-ended, meaning that the listing is not to be considered as excluding other, additional components or items.

BRIEF SUMMARY OF THE INVENTION

The present invention is directed toward various embodiments of an improved device for securing one or a collection of garment hangers which hang on a suspended hangrod. Certain embodiments of the present invention include but are not limited to the following description.

Various embodiments disclose an elongated, inverted generally U-shaped main body channel adapted to receive the span of suspended hangrod capping over a hanger hook portion of one or a collection of garment hangers. In another embodiment, a clamping assembly is fastened to the center top underside of a main body channel providing a means in which to affix the present device atop a suspended hangrod. A clamping assembly comprises a plurality of narrow clamping members with a particular diameter range holding capacity to thereby engage a suspended hangrod generally found in the field of the art.

Various embodiments are further directed to an elongated main body channel having particular outer and inner dimension and form to thereby cap over varied hanger hook size and shapes, further comprising a first end, a spaced apart second end, a substantially open bottom and underside, a shorter front portion, a back portion, a curved upper portion leading to a flattened center top, and a flattened underside center top portion. A clamping assembly is fastened hereto a flattened underside center top portion of an elongated main body channel and is mounted at an inset distance from a first end and to the spaced apart second end.

Various embodiments disclose a simple user action to thereby engage and disengage the present invention. Whereby to engage, a user can place the present invention atop a hanger hook portion of a hanger, pushing down onto the center top over a clamping member thereby affixing a clamping assembly onto a suspended hangrod. More specifically, a clamping assembly comprises a plurality of clamping members mounted, then fastened at an inset distance to a flattened underside center top portion at opposing ends of a main body channel. And further, narrow clamping members can affix between or next to a hanger hook portion of a hanger onto a suspended hangrod. In yet another embodiment, a clamping member may be fastened such as, by a plurality of aluminum rivets at a particular inset distance at opposing ends An inset distance can allow a recessed space thereby open to accommodate a users fingertips or thumb placed between a first end or a spaced apart second end and a clamping member to thereby lift up and off, enabling a simple action disengagement. This feature benefits improvement over prior art with ease of use and reusability. Secondly, an open distance at opposing ends of a main body channel can allow a hollow space to thereby accommodate various hangrod finials or fasteners which may be used to mount an existing hangrod to benefit present device versatility.

In another embodiment, a main body channel is formed thereby to encase and constrain various hanger hook shapes or sizes. Further embodiments of a main body channel can constrain a hanging hanger therein reduce swaying, shifting or a jumping motion that can result in hanger displacement during moving or transporting. More specifically, in various embodiments a main body channel dimension and form reveal a shorter front portion intended to thereby cap over and engage a hanger hook portion in reverse orientation to a hook shape. Engagement orientation reveals a shorter front portion of a main body channel aligning vertically to a neck portion of a hanger hook while directly facing a user and further, a back portion aligning to a first tip portion of a hanger hook and facing away from a user. Particularly, present device engagement orientation is intended to reduce motion to thereby stabilize and further restrict the area in which a hanger can sway back and forth.

Certain embodiments of this present invention include but are not limited to the description or various embodiments of a garment hanger retaining device wherein a main body channel or a clamping member is made by a process of mold manufacturing or extrusion of a plastic such as PVC or a flexible nylon plastic material. However, in different embodiments a main body channel and a clamping member can manufactured by a process having various physical characteristics and is not limited to a particular material and can be fabricated from numerous materials and manufactured by various methods and therefore the present device is not limited to the process of extrusion, mold manufacturing, or a specific material.

The problem of preventing a plurality of hangers or hanging objects from becoming displaced is solved by various embodiments of an improved garment hanger retaining device that can affix by a clamping assembly atop a suspended hangrod thereto receive and cap over a hanger hook portion of one or a collection of hangers.

More particularly, the present invention requires no advance assembly or permanent installation. Further, various embodiments benefit an ease with which one person can access and make use of a reusable lightweight invention with no moving parts. More preferred embodiments reveal a readily available device whereby with a simple action is transferable and can benefit versatility to those in the field of the art.

The present invention should therefore not be limited by the above described embodiment, and examples, but by all embodiments within the scope and spirit of the invention as stated.

DETAILED DESCRIPTION OF THE INVENTION

The present invention provides a hanger retaining device for securing one or a collection of hanging garment hangers and is illustrated in FIGS. 1-4 thereby indicating detail included in one and the same invention. Variations of embodiments include but not limited to descriptive detail of the present invention. All figures are not drawn to scale.

Figure 1:
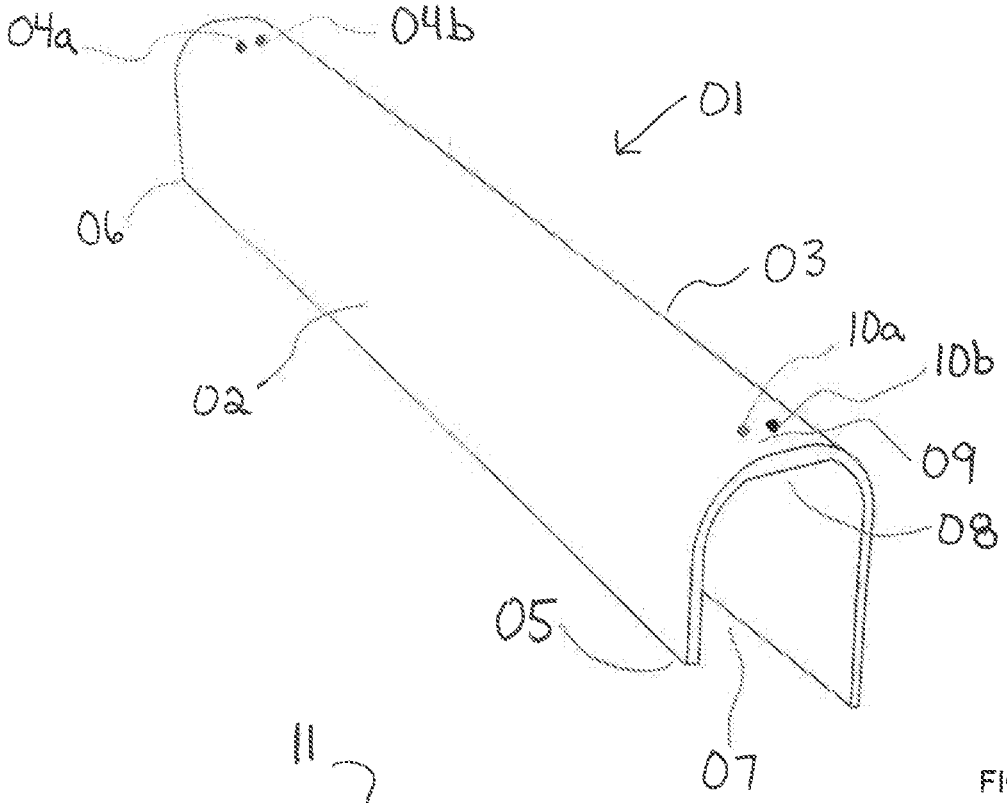
FIG. 1: is a perspective view depicting a hanger retaining device showing a main body channel according to the embodiment of the present invention.
Figure 2:
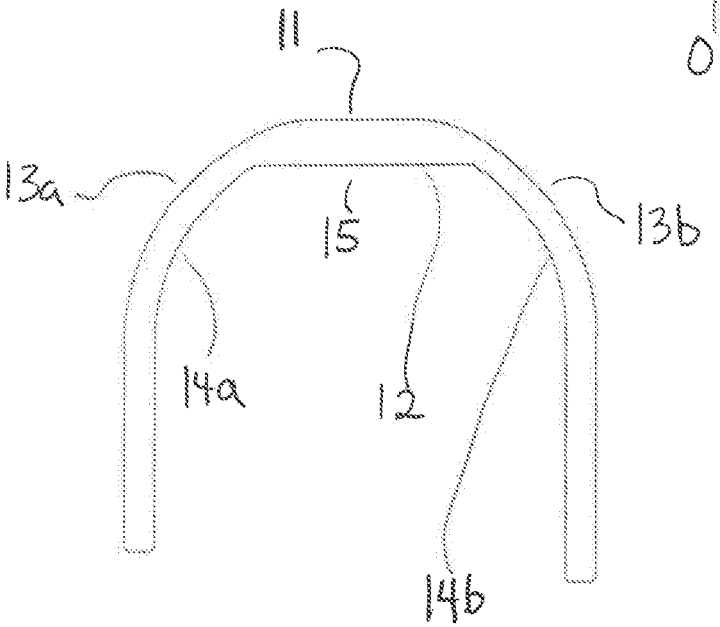
FIG. 2: is a perspective cross-section view depicting the present device having a main body channel dimension and form.

Referring now to FIG. 1, a perspective view of a main body and further in FIG. 2, a cross section view of the present invention. Showing an inverted generally U-shaped main body channel (01) having a first end (06), a spaced apart a second end (05), a shorter front portion (02), a back portion (03), a substantially open bottom and underside (07), an upper inside (14*a*, 14*b*) and outer curved (13*a*, 13*b*) dimension and form leading to a flattened center top portion (11), and a flattened underside center top (12) portion. Furthering revealed in FIG. 1 and FIG. 2, a mounting placement (15) is indicated for fastening a clamping assembly at an inset distance (04*a*, 4*b*) (10*a*,10*b*) at each opposing ends (05, 06). An inset mounting placement (04*a* 4*b*) (10*a* 10*b*) exposes a recessed open space (08, 09) for user thumb and fingertips placement to thereby lift off enabling disengagement. Additionally, the space benefits versatility to clear or pass over end parts, finials or various fasteners used for mounting an existing hangrod. A clamping assembly comprises two evenly spaced apart (05, 06) clamping members mounted then fastened (04*a*, 4*b*) (10*a*,10*b*) with a plurality of aluminum rivets at an inset point at opposing ends (05, 06).

Figure 3:
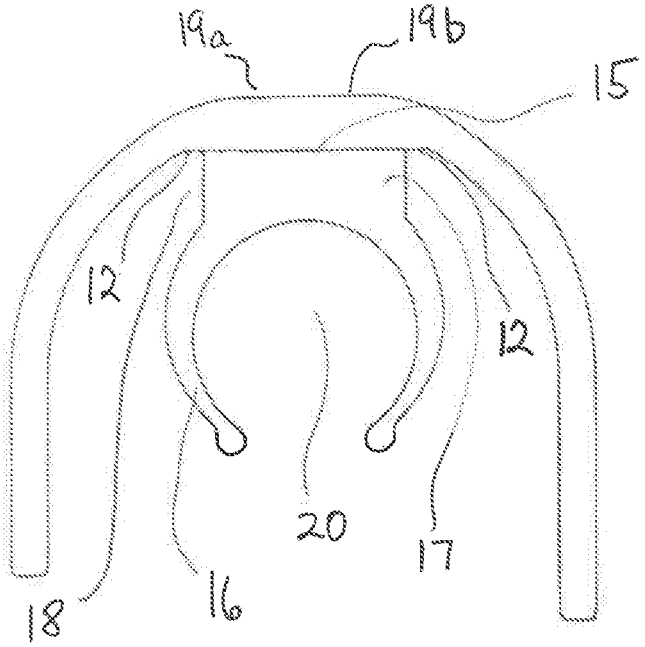
FIG. 3 is a perspective cross-section view showing a clamping member, a clamping member placement, and device orientation.

Referring further to FIG. 3, a cross-section perspective showing a mounted clamping member (16) fastened to flattened (15) underside center top (12) portion of a main body (01) channel. The drawing illustrates a clamping member (16) comprising a diameter range holding capacity (20) area, a narrow top spacer portion (17) which extends upwardly whereby indicating a means to allow space (18) between a hanger hook and an underside center top (12) portion, and to receive a plurality of fasteners (19*a*,19*b*).

Figure 4:
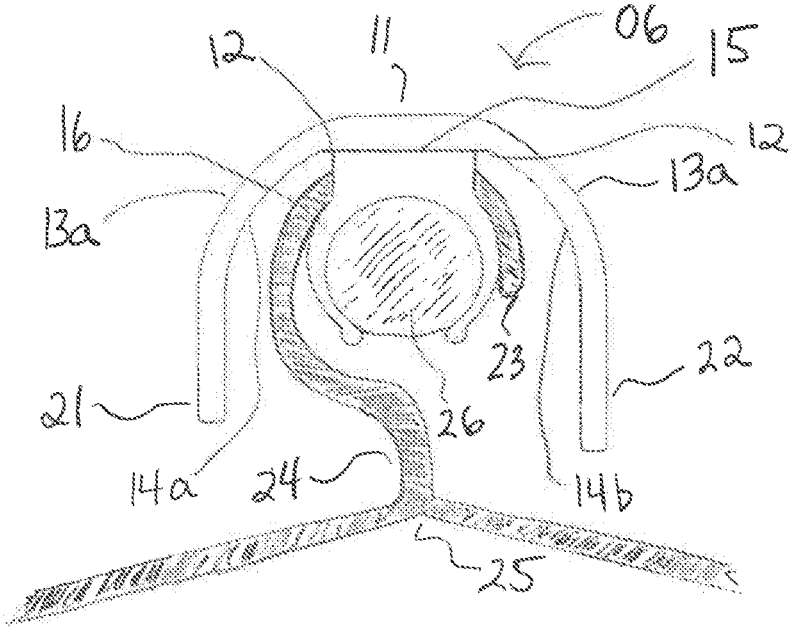
FIG. 4: is a persecutive cross-section view of a first end of a main body channel indicating device engagement orientation whereby a clamping member affixes to a suspended hangrod atop a hanger hook.

Referring further to FIG. 3 and to FIG. 4 both are a cross-section perspective showing further dimension and form of a main body (01) channel. Indicated in FIG. 4 an inner dimension and form (14*a*,14*b*) shaped to cap over a hanger hook (23, 24) portion and to allow open space (18) to thereby accommodate varied hook shape or sizes. Another aspect indicates a flat center top (11) portion having a flattened surface (12) to thereby reveal a mounting placement (15) for affixing a clamping member (16) with a plurality of fasteners (19*a*,19*b*).

Referring now to FIG. 4 a cross-section perspective view comprising components showing an upper inside (14*a*, 14*b*) and outer curved (13*a*, 13*b*) dimension and form of a shorter front portion (21) and a back portion (22) as a means to restrict movement of a hanging garment hanger (25). Illustrated as showing a first end (06) perspective of a main body (01) channel, a clamping member (16), a first end of a suspended hangrod (26), and a hanger hook portion (23, 24). Illustrated view shows a front (21) and back (22) device orientation, further aspects indicate orientation with a direction in which a hanger hook tip portion (23) and neck portion (24) are received atop a suspended hangrod (26) engaged thereby a clamping diameter holding capacity (20) of clamping member (16).

What is claimed is:

1. A garment hanger retaining device comprising:

a. an elongated main body whereby an inner and outer dimension form a channel shape, having a first end, a spaced apart second end, a substantially open bottom and underside, a front side portion, a back side portion, an upper portion leading to a flattened top center portion, and a flattened underside top center portion;

b. a clamping assembly comprising of a plurality of clamping members fastened hereto the underside top center portion of the elongated main body, each clamping member configured to snap fit onto a suspended hangrod, wherein each clamping member has a top spacer portion attached to the underside top center portion such that when each clamping member is attached to the suspended hangrod, a space is located between the suspended hangrod and the underside top center portion for allowing placement of a hanger hook portion on the suspended hangrod; and c. a plurality of fasteners to affix the clamping members to the main body.

2. The garment hanger retaining device of claim 1, wherein the channel shape of the elongated main body is an inverted generally U-shaped channel adapted to cap over the hanger hook portion and further to receive a horizontal span of the suspended hangrod.

3. The garment hanger retaining device of claim 1, wherein the fasteners comprise rivets, and wherein each clamping member is attached to the elongated main body and is inset adjacent a respective one of the first and second ends.

* * * * *